United States Patent [19]

Correa

[11] 4,197,897

[45] Apr. 15, 1980

[54] CLOSURE FOR BUILDING OPENING

[76] Inventor: Richard S. Correa, 14315 24 Mile Rd., Mt. Clemens, Mich. 48043

[21] Appl. No.: 914,661

[22] Filed: Jun. 12, 1978

[51] Int. Cl.[2] ..... E06B 3/48

[52] U.S. Cl. ..... 160/113

[58] Field of Search ..... 160/84 R, 133, DIG. 18, 160/113; 24/205 R, 205.15; 223/111

[56] References Cited

U.S. PATENT DOCUMENTS

| | | | |
|---|---|---|---|
| 1,756,043 | 4/1930 | Weidhass | 160/84 R |
| 1,925,815 | 9/1933 | Nicolson | 24/205 R |
| 3,092,172 | 6/1963 | Anderson | 160/133 |
| 3,331,425 | 7/1967 | Groves et al. | 160/113 |
| 3,568,901 | 3/1971 | McNitt | 223/111 |

*Primary Examiner*—Peter M. Caun

*Attorney, Agent, or Firm*—Charles W. Chandler

[57] ABSTRACT

A curtain for forming a substantially airtight closure for a building opening such as a doorway having a roll-up door at such time as the door is in its lower, closed position. A pair of remotely operated zippers connect opposite sides of the curtain to the opposite sides of the doorway.

6 Claims, 6 Drawing Figures

CLOSURE FOR BUILDING OPENING

BACKGROUND OF THE INVENTION

This invention is related to curtains disposed in a building opening usually closed only by a roll-up door formed of a series of interconnecting ribs, and more specifically, toward such a curtain that can be readily raised and lowered in a position adjacent the roll-up door.

Many industrial buildings have one or more relatively large openings, such as a doorway. A roll-up door is conventionally mounted in the opening so that it can be raised to admit a vehicle and then lowered to block the opening. Such a door is usually made of a series of horizontal, interconnected ribs that permit the door to be formed into a roll adjacent the top of the door opening.

The conventional door structure, when closed, usually permits air to pass from the exterior of the building into the interior. During extremely cold weather, the interior of the building in the vicinity of the door, is very difficult to heat and is uncomfortable for workmen to perform their jobs.

SUMMARY OF THE INVENTION

The broad purpose of the present invention is to provide a curtain that is mounted adjacent a conventional closure to form a substantially airtight closure in a building opening. The curtain is preferably formed of a vinyl material and connected by a pair of molded zippers to the sides of the door opening. Each zipper is connected the full height of the curtain. A cord is attached to the zipper slider and looped around pulleys adjacent the top and the bottom of the opening to provide means for the user to raise and lower the zipper.

In its closed position, the curtain significantly reduces the heat loss through the door opening.

Still further objects and advantages of the present invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
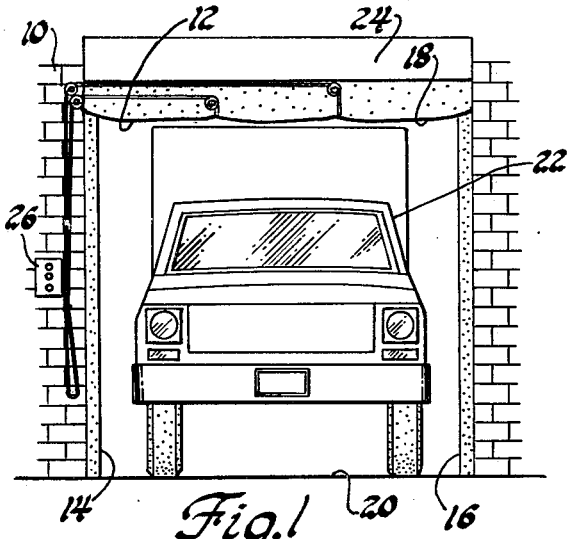
FIG. 1 illustrates a building opening having a conventional roll-up door and a curtain illustrating the preferred embodiment of the invention, both being raised to permit passage of a vehicle through the opening.

Referring to the drawing, FIG. 1 illustrates a building wall 10 having an opening 12 defined by sides 14 and 16, a top 18 and floor 20. The width and height of opening 12 accomodates the passage of a vehicle 22 into the building.

Figure 2:
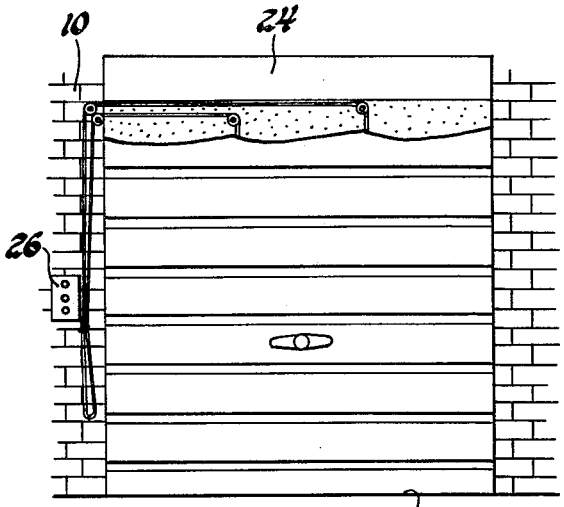
FIG. 2 illustrates a building opening in which the roll-top door is in its lower, closed position, and the curtain is raised.

A conventional roll-up door 24 is illustrated in FIG. 2, in its lower, closed position. Control means 26 permit the user to automatically raise the door to a rolled up position in a housing 28 to permit the passage of vehicle 22 through the door opening. Door 24 is conventionally formed of a plurality of elongated, horizontal ribs interconnected to form a continuous structure.

Figure 3:
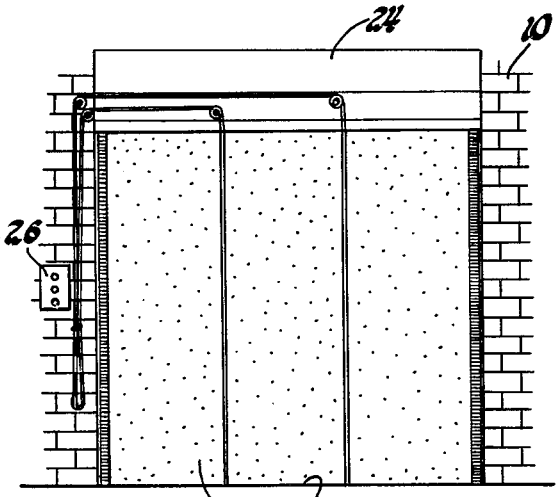
FIG. 3 is a view illustrating the curtain in its lowered position.

FIG. 3 illustrates a curtain 30 disposed in opening 12. Curtain 30 is preferably made of a vinyl, laminated, ultra-violet resistant, flexible, substantially air-impervious material. Curtain 30 has a width accomodating the distance between the top of the door opening and the floor.

Figure 4:
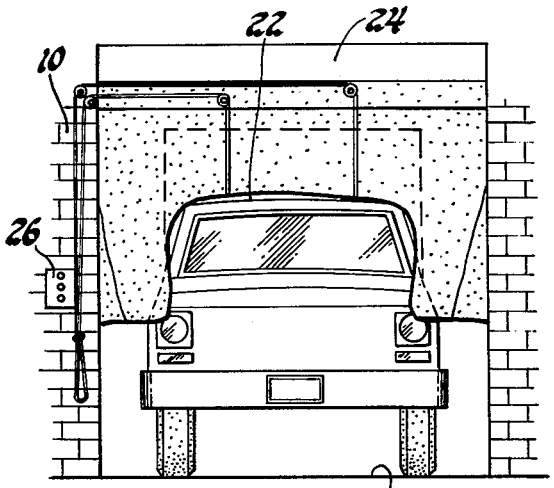
FIG. 4 illustrates the curtain in its partially closed position draped about a vehicle disposed in the opening.

Referring to FIG. 4, a pair of 2 inch by 12 inch wooden boards 32 and 34 are mounted adjacent the sides of opening 12 so as to extend into the building. Boards 32 and 34 are set in caulking to seal any irregularities between the sides of the opening and the boards. A horizontal flange 36 is connected between the boards beneath housing 28. The curtain is attached to flange 36.

A chain 38 is stitched into a seam 40 along the bottom horizontal edge of the curtain.

Figure 6:
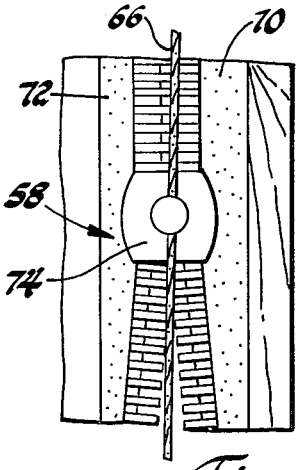
FIG. 6 is an enlarged view of a typical zipper connecting the curtain to the side of the opening.

A pair of cords 42 and 44 are employed for raising and lowering the curtain from its bottom position illustrated in FIG. 6, to its upper position illustrated in FIG. 1. Cord 42 has one end attached to flange 36 outside of the curtain and adjacent its top. The cord is then looped around the curtain, around a pulley 48 so that its opposite end hangs down so as to be easy to reach. Similarly, cord 44 has one end connected to flange 36 and then is looped around the curtain, around a pulley 50 and then around a second pulley 52 to hang down parallel to cord 42. The two cords are knotted at 54 so that they can be raised lowered together.

Zipper means 56 connect one side of the curtain to board 32, while zipper means 58 connect the opposite side edge of the curtain to board 34.

A looped cord 60 is connected to zipper means 56 for opening and closing it. Cord 60 is looped around an upper pulley 62 and a lower pulley 64. A cord 66 is connected to zipper means 58 and around an upper pulley 68 and lower pulley 70 to assist the user in raising and lowering the zipper. The two zippers are connected in an identical manner between their respective boards and curtain sides.

Referring to FIG. 6, zipper means 58 includes a tape 70 stapled to board 34 and a second tape 72 attached to the side edge of the curtain. A slider 74 is operative to connect the two tapes 70 and 72 together when the slider is lowered, and to permit separation of the two tapes when the slider is raised. Cord 66 is attached directly to the slider and not to the handle provided with the conventional commercial sliders to permit the user to have a remote control means for opening and closing the zipper. The zipper means 56 connected to the opposite side edge of the curtain is connected and operates in a similar manner to zipper means 58.

Figure 5:
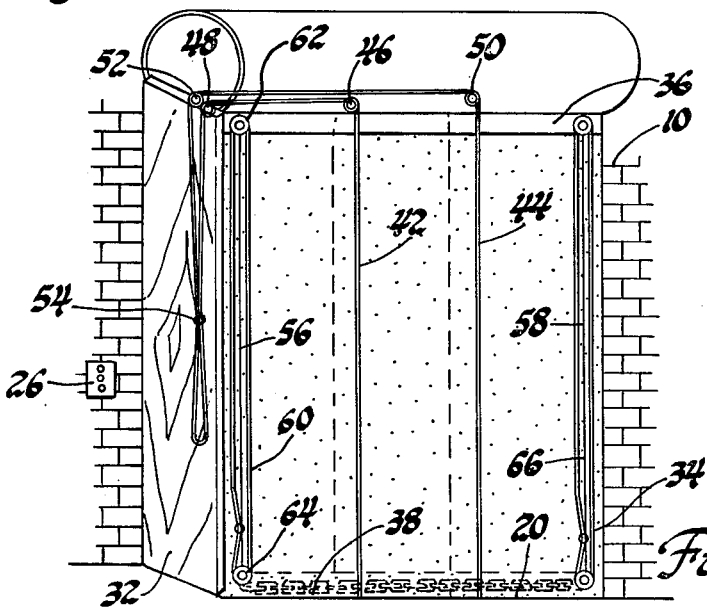
FIG. 5 is a fragmentary perspective view of the preferred curtain.

When both zippers are lowered, as illustrated in FIG. 5, the curtain provides a substantially airtight closure in the door opening. The user can quickly open the door to permit passage of the vehicle by manipulating cords 60 and 66 to raise the zipper sliders. The user then pulls on the outer ends of cord 42 and 44 to raise the curtain.

It is to be noted that there are times when the vehicle may be partially disposed in the door opening so that the roll-up door has to be in its raised position. The preferred curtain can be partially closed as illustrated in FIG. 4 because the flexible chain carried adjacent the lower seam causes the curtain to partially close the door opening and thereby reduce the loss of heat from the building. The preferred curtain is not only efficient for reducing heat loss, but is easily installed in a conventional doorway.

The invention is applicable to other building exterior openings, such as window openings, vent openings, and the like.

Having described my invention, I claim:

1. In a building having means defining an opening, and a roll-up door blocking said opening, a combination comprising:

flexible curtain means mounted adjacent said roll-up door and having a pair of sides defining a curtain width accomodating the width of said opening, and a height accomodating the distance between the top and the bottom of the opening;

means attaching the upper end of said curtain to the top of the opening such that the opposite, bottom end of the curtain is movable from a lower position adjacent the bottom of the opening toward an upper position;

means for raising the curtain from said lower position to said upper position;

fastener means including a fastener member, connecting the curtain sides to the sides of the opening, the fastener member being operative to permit the sides of the curtain to be separated from the sides of the opening; and an elongated flexible cord connected to the fastener member for moving it to connect the sides of the curtain to the sides of the opening as the fastener member is being moved toward the floor whereby the curtain is operative to form a substantially airtight closure in said opening as said roll-up door is blocking said opening but permitting air to pass therethrough.

2. A combination as defined in claim 1, in which the fastener means comprises a zipper means and the fastener member comprises a zipper slider.

3. A combination as defined in claim 1, in which the curtain has a horizontal bottom edge, and including a chain stitched to the curtain adjacent said horizontal bottom edge.

4. A combination as defined in claim 1, in which the means for raising the curtain includes an elongated cord having one end connected to the building opening adjacent the opening top and a mid-section looped around the curtain, and including pulley means connected to the building for engaging said cord whereby the user can raise the curtain by pulling on the cord.

5. A combination as defined in claim 1, in which the curtain is formed of a substantially airtight vinyl material.

6. In a building having a pair of spaced sides, a top and a floor defining an opening admitting a vehicle, a combination comprising:

a roll-up door for blocking said opening;

flexible curtain means having a pair of sides defining a curtain width accomodating the width of said opening, and a height accomodating the distance between the top of the opening and the floor;

means attaching the upper end of said curtain to the top of the opening such that the opposite, bottom end of the curtain is movable from a lower position adjacent the floor toward an upper position adjacent the opening top;

means for raising the curtain from said lower position to said upper position to permit the passage of a vehicle through said opening;

fastener means including a fastener member, connecting the curtain sides to the sides of the opening, the fastener member being operative to permit the sides of the curtain to be separated from the sides of the opening; and an elongated flexible cord connected to the fastener member for moving it to connect the sides of the curtain to the sides of the opening as the fastener member is being moved toward the floor whereby the curtain is operative to form a substantially airtight closure in said opening as said roll-up door is blocking said opening but permitting air to pass therethrough.

* * * * *